United States Patent [19]

Jenkins et al.

[11] Patent Number: 4,681,258

[45] Date of Patent: Jul. 21, 1987

[54] PRODUCING DIRECTED SPRAY

[75] Inventors: Walter N. Jenkins; Gordon I. Davies, both of Swansea, Wales

[73] Assignee: National Research Development Corporation, London, England

[21] Appl. No.: 871,923

[22] Filed: Jun. 9, 1986

Related U.S. Application Data

[63] Continuation of Ser. No. 603,368, Apr. 24, 1984, abandoned.

[30] Foreign Application Priority Data

Apr. 25, 1983 [GB] United Kingdom ..... 8311167

[51] Int. Cl.[4] ..... B05C 5/00

[52] U.S. Cl. ..... 239/66; 239/81; 239/83; 239/297; 239/422; 137/624.13; 137/625.31

[58] Field of Search ..... 239/66, 79–85, 239/290, 292, 297, 298, 422, 563, 151; 219/76.16, 121 PL, 121 PY; 137/624.13, 625.31

[56] References Cited

U.S. PATENT DOCUMENTS

| | | | |
|---|---|---|---|
| 1,143,778 | 6/1915 | Pembroke | 137/624.13 X |
| 2,367,319 | 1/1945 | Wahlberg | 137/624.13 |
| 2,974,681 | 3/1961 | Whitehurst | 137/624.13 |
| 4,064,295 | 12/1977 | Singer | 239/297 X |
| 4,066,117 | 1/1978 | Clark et al. | 239/290 X |

FOREIGN PATENT DOCUMENTS 1262471 2/1972 United Kingdom .

*Primary Examiner*—Andres Kashnikow
*Assistant Examiner*—Mary Beth O. Jones
*Attorney, Agent, or Firm*—Cushman, Darby & Cushman

[57] ABSTRACT

For uniformly coating a substrate with a spray, a stream of liquid falls past a point towards which a plurality of nozzles in a bank are all directed but at different angles. Bursts of atomising gas are sprayed through the respective nozzles in a repeated sequence, such as to cause a repeated sequence of equal durations of spray in a plurality of directions.

5 Claims, 11 Drawing Figures

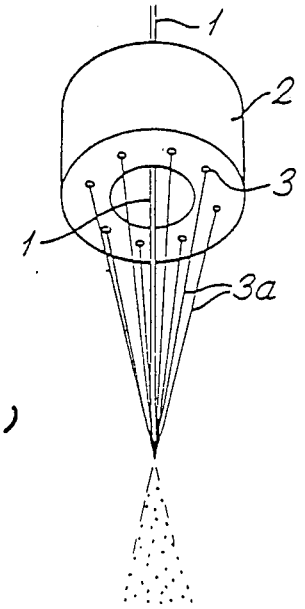
Fig. 1
(PRIOR ART)
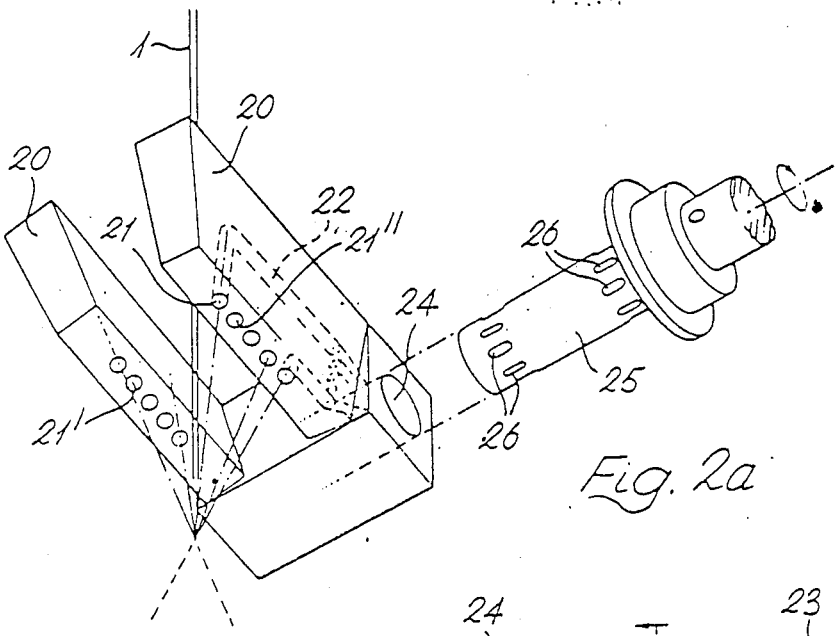
Fig. 2a
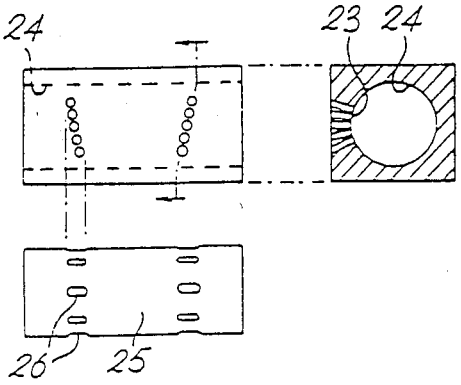
Fig. 2b
Fig. 2c

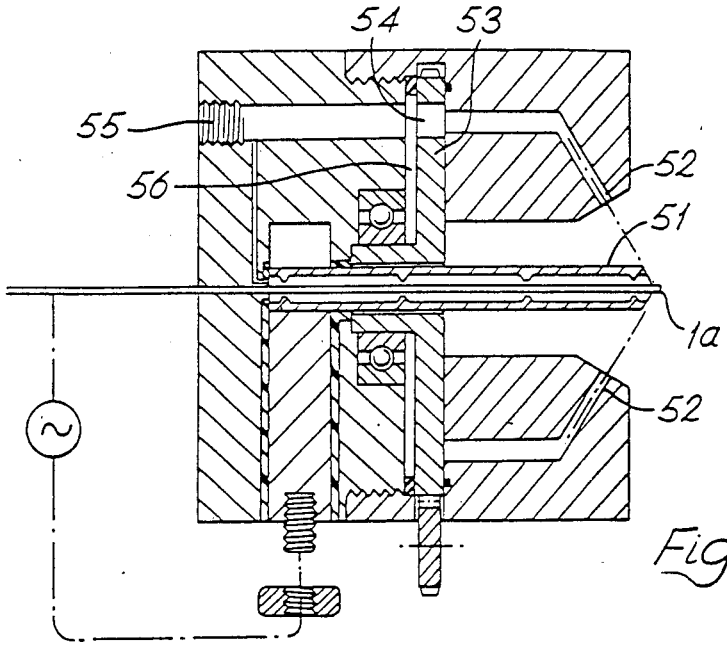
Fig. 5
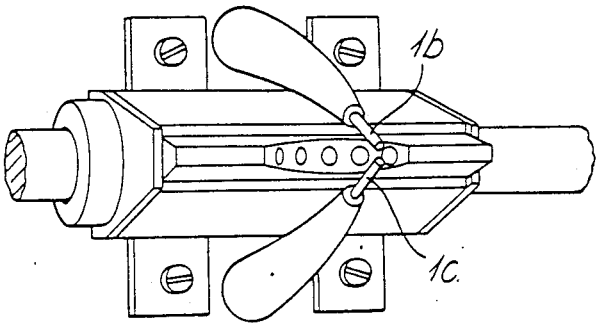
Fig. 6
Fig. 7
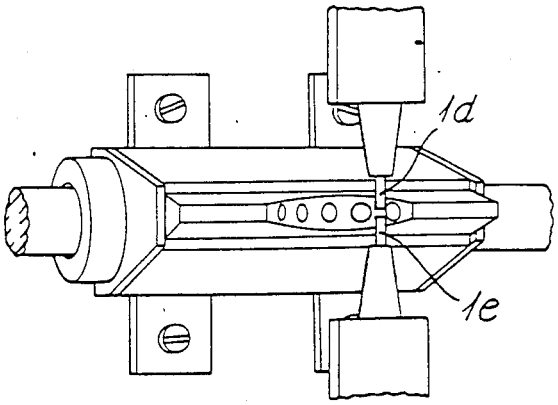

PRODUCING DIRECTED SPRAY

This is a continuation of application Ser. No. 603,368, filed Apr. 24, 1984, now abandoned.

This invention relates to the production of, and imparting of direction to, a spray. This activity may find application in the uniform coating of a substrate with a spray.

Sprayed coatings of liquid metals or paints are frequently applied to substrates for decoration or protection. In their simplest form, spray generators consist of single gas nozzles, which have a circular orifice (for producing an axially symmetric cone of particles) or an elliptical orifice. UK Patent Specification No. 1262471 discloses a more developed atomizing arrangement, in which liquid metal falls as a stream through an inwardly-aimed annular gas jet, which jet, when actuated, atomises the stream, i.e. generates a spray. However, this arrangement is unable to form a uniform coating across a wide flat substrate, because particle distribution, even if uniform in terms of mass flow per unit solid angle, is inevitably less at the edges of a wide flat substrate. To overcome this, the whole arrangement (or the substrate) must be moved laterally to and fro, to even out the distribution.

UK Patent Specification No. 1455862 discloses an arrangement for more closely approaching uniformity of coating, whereby a stream of liquid is gas-atomised, and a cyclically varied secondary gas stream is directed against the gas-atomized stream to impart an oscillation thereto substantially in a single plane. However, even this arrangement does not give an ideal control of particle distribution.

According to the present invention, a method of producing, and imparting a direction to, a spray comprises forming an unsupported supply of liquid (e.g. of metal, e.g. a falling stream or by striking an arc to a consumable electrode or between consumable electrodes) and providing a plurality of atomising gas nozzles at different locations all directed to the same point in said supply, characterised in that the nozzles are repetitiously actuated sequentially, whereby to atomise the liquid into a spray and impart repetitiously a sequentially varying direction to the spray.

Also according to the invention, an arrangement for producing, and imparting direction to, a spray comprises means for forming an unsupported supply of liquid (e.g. a vessel with an orifice, or a consumable electrode connected to an arc generator), a plurality of atomising gas nozzles at different locations all directed to the same point, being a point past which the supply can flow, characterised by control means such as a sleeve valve which can repetitiously vary the flows of gas through the nozzles individually or in groups in a predetermined sequence.

Figure 3:
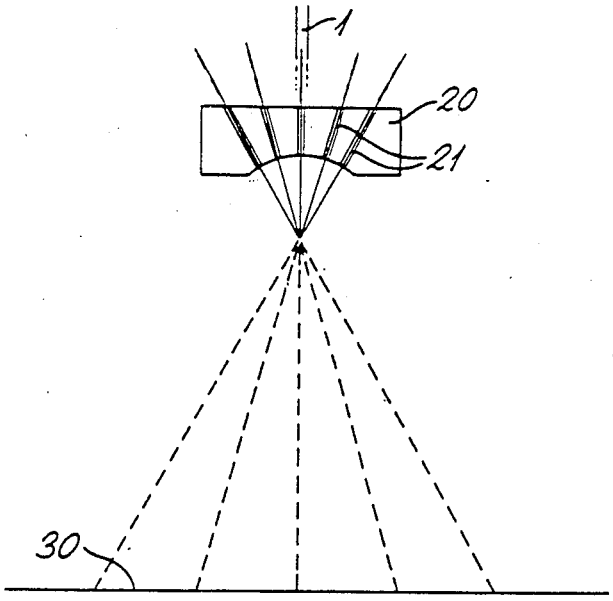
Figure 4:
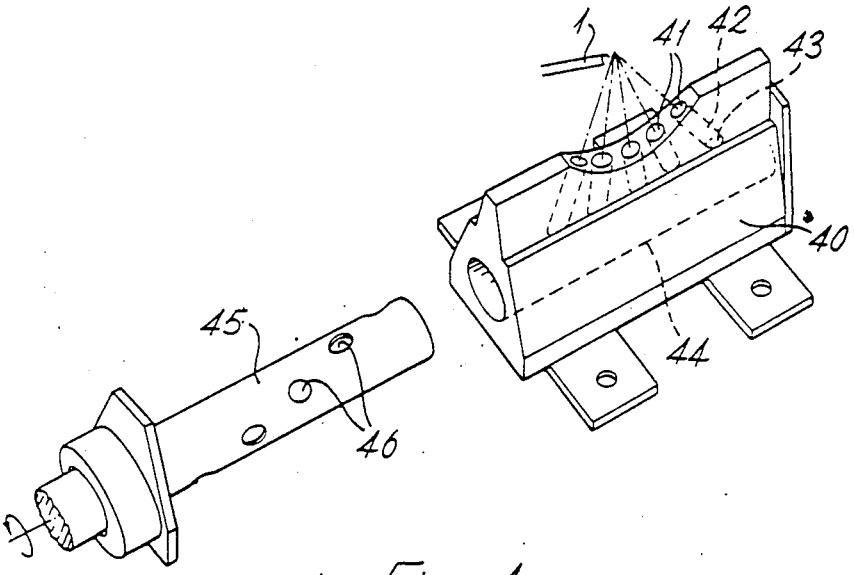
Figures 8A, 8B:
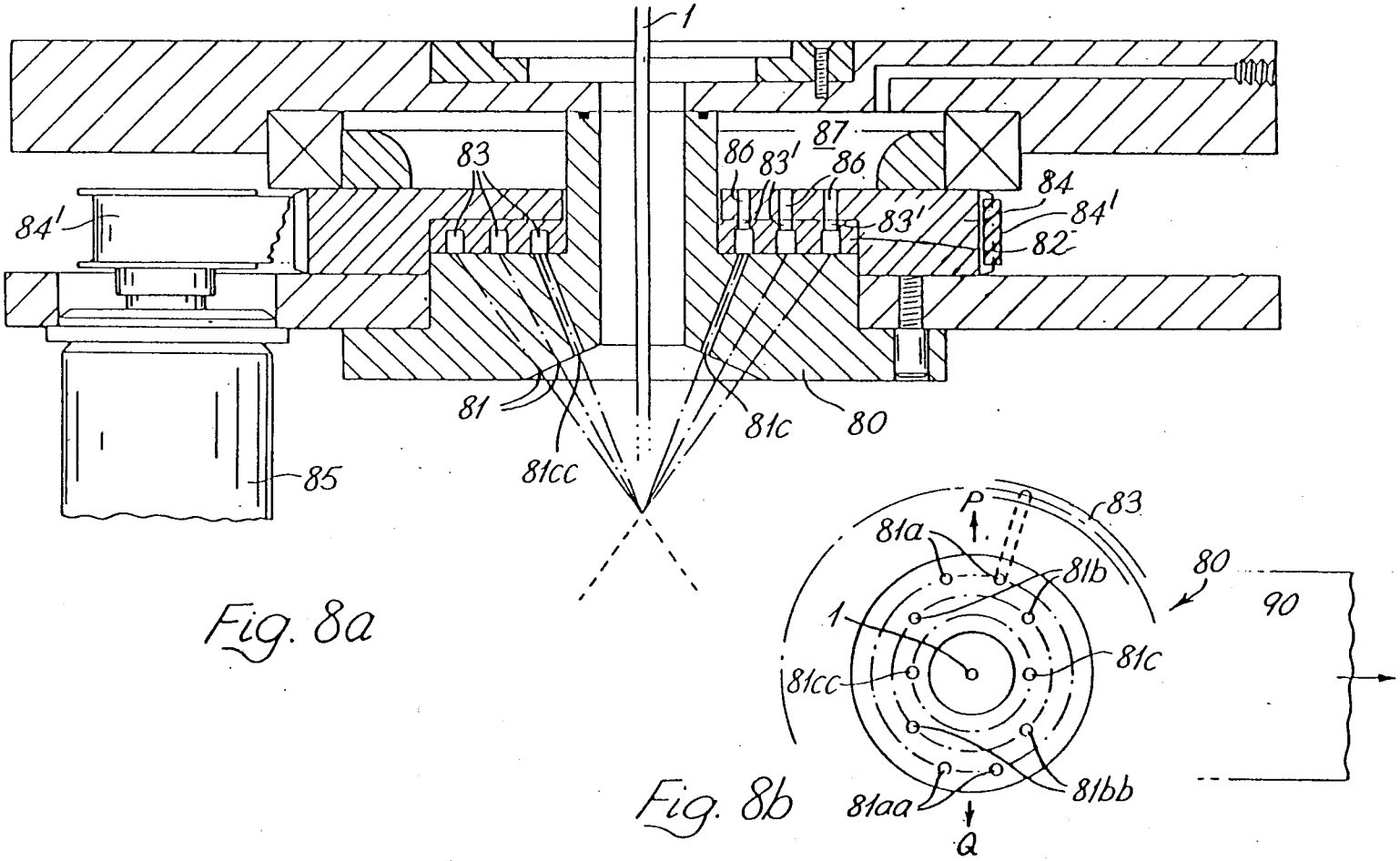

The invention will now be described by way of example with reference to the accompanying drawings, in which:

FIG. 1 (not according to the invention) shows a conventional spray generator, FIG. 2*a* (like all following Figures, illustrating the invention) is an exploded view of an arrangement for producing and directing spray, with FIGS. 2*b* and 2*c* showing parts of the arrangement in more detail, FIG. 3 is a schematic indication of how the arrangement of FIG. 2 is capable of imparting an even coating on a substrate, FIG. 4 shows a simplified version of the FIG. 2 arrangement, FIG. 5 shows apparatus capable of spraying the inside of a tube according to the invention, FIGS. 6 and 7 show arc discharge means for producing an unsupported supply of liquid, used in conjunction with the spray-directing arrangement of FIG. 3, and FIGS. 8*a* and 8*b* show a further arrangement for producing and directing spray.

FIG. 1 shows a conventional spray generator. An unsupported supply of liquid falls as a stream 1 through an annular nozzle block 2 which is drilled with axially symmetrical convergent bores 3. Atomising gas is fed to all the bores from a common manifold (not shown) and all the resulting gas jets 3*a* impinge on the stream 1 at the same point, breaking up the stream into a spray.

FIG. 2*a* is an exploded view of an arrangement according to the invention for producing and directing spray, which may be used when the spray is to be directed in a plane containing the liquid stream from which it is produced. A liquid stream 1 flows centrally between a pair of mirror-image banks 20 of atomizing nozzles. Each bank 20 has drilled in it five co-planar bores forming nozzles 21 converging at a point on the path of the liquid stream (both banks 20 converging at the same point). Each bore to a nozzle 21 is fed with atomizing gas through an individual duct 22 opening through an orifice 23 into a cylindrical sleeve valve chamber 24.

FIG. 2*b* shows the sleeve valve chamber 24, and also (cross-hatched) a sectional view of the chamber taken squint, on a plane including one set of orifices 23.

FIG. 2*c* shows, in correct relative position with respect to FIG. 2*b*, a hollow rotor 25. As best appreciated by consulting all of FIGS. 2*a*, 2*b* and 2*c*, the hollow rotor 25 fits in the chamber 24 and has two identical series of apertures 26 which, when the rotor 25 rotates, come into register in turn with each orifice 23. The hollow centre of the rotor 25 is supplied with atomising gas under pressure. The orifices 23 in this example are arranged around left and right hand helices, and two identical sets of apertures 26 in the rotor 25 serve each bank of five nozzles 21 so that the two nozzles of each pair e.g. 21', 21'' receive gas at the same pressure simultaneously for the same periods of time.

Thus, in use impulses of gas dispensed to selected individual corresponding pairs of nozzles e.g. 21', 21'' so as to atomise the stream and simultaneously to direct it to one side or another of the axis of the undisturbed stream as required, always in the mirror-imaging plane defined by the banks 20, and according to a predetermined program. Thus, a continuously moving strip advancing in a direction normal to the mirror-imaging plane will be scanned by the spray and may be reasonably evenly coated.

Any number of nozzles 21 could of course be used in a wide variety of configurations (the same on each bank 20) according to the thickness distribution required for the product. A large number of nozzles would reduce unwanted thickness variations due to discrete bursts of particles, but this advantage may be offset by increased complication of the atomiser and valvegear. In practice there is no advantage in using more than 12 pairs of nozzles. For this example, five pairs of nozzles are used and each group of five is contained in a plane subtending an angle of 10° to the liquid stream. (Other angles would be set for other examples depending on the characteristics of the material being atomised and the required particle size distribution). The angle subtended by each pair of nozzles to the liquid stream is also set by experience so as to produce the required thickness distribution but in the present example these angles are set so that the five planes containing respectively the five pairs of nozzles would intersect at equal distances across the width of a moving strip passing under the atomiser.

The rotor 25 ensures equal ratios of switched-on to switched-off for each pair, and so five distinct and equal bursts of particles are deposited at equal distances across the width of the strip, providing reasonably equal coating weight over equal widths of strip, this being discussed more fully in relation to FIG. 3.

The ratio of rotor aperture diameter 26 to nozzle diameter is chosen to provide a smooth changeover between pairs of nozzles and a smooth transition produced in this manner has been found to reduce the lateral thickness variations which would arise if the pneumatic valve produced discrete spurts of particles in succession.

In FIG. 3, a strip 30 being coated is advancing into the paper. The banks 20 (only one shown) of FIG. 2 flank the falling liquid stream 1. Each nozzle 21 of the five on each bank has an equal time of being activated. This results in five equal time-bursts of particles beyond the point of intersection, these sharply separated bursts being in practice more smoothly merged under the 'smooth changeover' provisions described. These can give a uniform lateral coating weight distribution to within ±2% across a 300 mm wide strip when aluminium was being applied at 5 meters/minute using a gas pressure of 0.7 MN $m^{-2}$. The cycle time of the repetitious activation programme was not critical but a convenient speed of the rotor 25 gave a cycle time of 0.005 secs.

When a spray is to be projected in a plane not containing the original liquid stream, the simplified arrangement of FIG. 4 may be adequate when it is required to form a uniform layer on a moving strip.

A single bank 40 of atomising nozzles 41 is set up in relation to a liquid stream 1 as if it were one of the banks 20 of the arrangement of FIG. 2. The nozzles 41 are drilled in the bank 40 as co-planar bores converging at a point on the liquid stream. Each bore to a nozzle 41 is fed with atomising gas through an individual duct 42 opening through an orifice 43 into a cylindrical sleeve valve chamber 44.

A hollow rotor 45 fits in the chamber 44 and has a set of apertures 46 which, when the rotor 45 rotates, come into register in turn with each orifice 43. The hollow centre of the rotor 45 is supplied with atomising gas under pressure. The same principles govern the operation of the valve as for FIG. 2 but in this example the nozzles 41 operate singly rather than in pairs, with a result that the general direction of the sprayed particles is not the same as the direction of the liquid stream. The particles can be deflected through any angle between say 10° and 90° depending on how the arrangement is set up.

Turning to FIG. 5, means for forming an unsupporting supply of liquid are an arc struck to a consumable electrode 1*a* from a tubular non-consumable electrode 51. The arc is struck at the point of convergence of eight spaced axially symmetrically disposed atomising nozzles 52 (only two shown) connected sequentially to a source of atomising gas under pressure. A disc 53 with a single hole 54 is arranged to close all, except at most one, of the bores feeding the nozzles 52. Gas supplied under pressure through an entry 55 to a manifold 56 activates whichever nozzle 52 is in register with the hole 54 at any instant, the disc 53 being arranged to rotate at high speed. Atomising gas striking the pool of liquid formed be arc-melting of the consumable electrode 1*a* forms a spray concentrated in the appropriate direction.

The arrangement shown in FIG. 5 is especially suitable for uniformly coating the inside of a tube. The array of generally radial nozzles 52 is directed at the consumable electrode 1*a*which is, in use, situated coaxially in the tube to be coated. The nozzles are also inclined such that sprayed particles are deposited as a moving ring of particles concentrated some distance in advance of the arrangement, which is consequently kept sustantially clear of those sprayed particles which fail to adhere to the tube.

In FIGS. 6 and 7, arc discharge means are shown for producing an unsupported supply of liquid, in each case in conjunction with the spray-directing arrangement of FIG. 3. In FIG. 6, the arrangement is a modification of a standard hand-held pistol in which consumable electrode wires 1*b*, 1*c* each subtend an angle of 30° to the plane of the nozzles (41, FIG. 3). FIG. 7 shows a modified arrangement; horizontally opposed wires 1*d*, 1*e*, may provide a more satisfactory arrangement of wire feed, by providing a complete axial symmetry of arc and gas jets.

Turning to FIG. 8*a*, an arrangement, shown in section, for producing and directing spray comprises an upright tubular assembly through the centre of which a stream 1 of liquid can flow. The assembly has a tubular nozzle block 80 in which are drilled converging bores 81 all directed to the same point on the liquid stream 1. The disposition of the bores 81 is described more fully in relation to FIG. 8*b*, but they all fall in three notional circles concentric with the stream 1.

A timer ring 82 is rigidly clamped to the nozzle block 80; different (interchangeable) timer rings may be made and kept available for different circumstances. The timer ring 82 has three annular galleries 83 open to the three sets of bores 81, the two outermost galleries 83 being divided along a diameter (perpendicular to PQ) into two non-communicating semi-circular galleries.

Each of the galleries 83 has a feed slot 83' open to the top surface of the timer ring. The shape and circumferential extent of each of these feed slots 83' strongly influence the performance of the arrangement, and may be different in different timer rings.

A rotor 84 is driven through a toothed belt 84' by a motor 85, to slide bodily over the timer ring 82. Three bores 86 are formed in the rotor 84, parallel to its axis, and for illustration are shown in register with each of the feed slots 83'. In fact this would never be the case; the bores 86 would instead be staggered circumferentially.

A gas manifold 87, supplied with atomising gas under pressure, surmounts the rotor 84 and continuously supplies the bores 86. These in turn transmit gas to the galleries 83 and thence the bores 81 during those moments when the bores 86 on the rotor 84, in the course of rotation of the rotor, happen to register with the respective feed slots 83'.

FIG. 8*b* is an inverted plan view of the nozzle block 80. As will be seen, there are ten bores 81, falling (as has been mentioned) on three notional concentric circles a, b and c.

The timer ring 82 is so formed that, when the rotor 84 operates, the two nozzles 81*a* are actuated for some moments, causing the liquid stream 1 to be atomised and directed in the direction Q. The liquid stream 1 is coming straight towards the reader, upwardly from the paper. A substrate 90 to be sprayed may be supposed to be moving transversely, as shown. Next, the two nozzles 81*b* are actuated instead causing the liquid stream 1 to be atomised and directed slightly in the direction Q. Next, the two nozzles 81*c* and 81*cc,* whereby spray is formed and continues substantially undiverted from the vertical. Next, the two nozzles 81*bb,* whereby spray if formed and directed slightly in the direction P. Finally, the two nozzles 81*aa,* whereby spray is formed and directed considerably in the direction P.

The whole cycle is then resumed, with 81*a,* and repeated fast compared with the rate of advance fo the substrate 90, giving a reasonably even coating.

In this example, the 'cone' of spray is spread in the direction PQ transversely to the substrate 90, but kept very narrow in the longitudinal direction.

In a simplified version of timer ring 82, the ten feed slots 83' are elongated according to the length of gas pulse required for each nozzle. The galleries 83 are stopped off so that each feed slots 83' feeds only a single nozzle 81. It will be noticed that in addition to spreading the cone in the direction P or Q transverse to the strip substrate, as required by the invention, there is also somewhat of a spread in the longitudinal direction, and this may be tolerable if sufficiently compensated for by the longitudinal movement of the substrate 90.

We claim:

1. An arrangement for evenly coating a surface with a spray, comprising means for forming an unsupported supply path of liquid, a gas supply, a plurality of atomizing gas nozzles each disposed at a different location and all directed at the same point, being a point in the supply path along which the liquid will flow, control means between the gas supply and said nozzles for imparting a varying direction to the spray, the control means repetitiously varying the flow of gas through the nozzles in a predetermined sequence of at least three flow patterns said patterns being associated with an arrangement of said nozzles, said arrangement comprising respectively at least one pair of said nozzles for each said pattern, each nozzle of a pair being disposed in mirror image to the other nozzle of the pair about a fixed vertical mirror plane including the supply path, the said control means comprising, facing said gas supply, a continuously driven rotating disc, and, in sliding contact with said rotating disc, a static aperture timer disc, said rotating disc having windows which register in sequence with respective apertures in said timer disc, said apertures feeding respective said nozzles.

2. The arrangement as claimed in claim 1, wherein the means for forming the unsupported supply of liquid is a vessel with an orifice.

3. The arrangement as claimed in claim 1, wherein the means for forming the unsupported supply of liquid is a consumable electrode connected to an arc generator.

4. The arrangement as claimed in claim 1, wherein said windows are distributed over at least two concentric circles of different radii and each of which registers in sequence with a respective one of said apertrues in said timer disc.

5. The arrangement as claimed in claim 4, wherein said windows comprise elongated slots formed in said rotating disc with said slots being located at different radii.

* * * * *